US009926168B2

(12) United States Patent
Berger et al.

(10) Patent No.: US 9,926,168 B2
(45) Date of Patent: Mar. 27, 2018

(54) DEVICE FOR ADJUSTING THE INTER-FLANGE SPACE OF A BOBBIN

(71) Applicant: Conductix Wampfler France, Colombes (FR)

(72) Inventors: Jean-Michel Berger, Belley (FR); Bruno Parseihian, Magnieu (FR)

(73) Assignee: CONDUCTIX WAMPFLER FRANCE (FR)

( * ) Notice: Subject to any disclaimer, the term of this patent is extended or adjusted under 35 U.S.C. 154(b) by 230 days.

(21) Appl. No.: 14/782,565

(22) PCT Filed: Apr. 11, 2014

(86) PCT No.: PCT/EP2014/057405
§ 371 (c)(1),
(2) Date: Oct. 5, 2015

(87) PCT Pub. No.: WO2014/167105
PCT Pub. Date: Oct. 16, 2014

(65) Prior Publication Data

US 2016/0046461 A1 Feb. 18, 2016

(30) Foreign Application Priority Data

Apr. 11, 2013 (FR) ..... 13 53267

(51) Int. Cl.
*B65H 75/24* (2006.01)
*B65H 75/14* (2006.01)

(52) U.S. Cl.
CPC ..... *B65H 75/24* (2013.01); *B65H 75/14* (2013.01); *B65H 75/145* (2013.01); *B65H 2701/32* (2013.01)

(58) Field of Classification Search
CPC ..... B65H 75/14; B65H 75/24; B65H 75/145
See application file for complete search history.

(56) References Cited

U.S. PATENT DOCUMENTS 1,664,074 A 3/1928 Heffernan
1,915,825 A 6/1933 Hescock
(Continued)

FOREIGN PATENT DOCUMENTS

CA 2263058 A1 8/2000
GB 2468536 A 9/2010

OTHER PUBLICATIONS

International Search Report dated Jun. 23, 2014 for PCT/EP2014/057405.

*Primary Examiner* — Sang K Kim
(74) *Attorney, Agent, or Firm* — Ryan T. Grace; Advent, LLP

(57) ABSTRACT

The invention concerns a bobbin (1) for winding and unwinding a link such as a cable or similar, comprising: • a central mandrel (10) comprising two opposing faces (11, 12) perpendicular to a rotational axis (13) of the bobbin (1), • two sets of arms (21) each mounted on a respective opposing face of the central mandrel (10), each arm being in contact with an intermediate support positioned between the two ends of same, • characterized in that the bobbin comprises a plurality of adjustment elements (30) each associated with a respective arm, the actuation of an adjustment element resulting in a force being applied to the associated arm of same through the intermediate support, the application of said force tending to vary the inclination of said arm around the intermediate support in such a way as to adjust the position of said arm in a plane essentially parallel to the rotational axis of the bobbin.

16 Claims, 5 Drawing Sheets

(56) References Cited

U.S. PATENT DOCUMENTS

| | | | | | |
|---|---|---|---|---|---|
| 2,226,961 | A | | 12/1940 | Arnold | |
| 3,791,606 | A | * | 2/1974 | Brown | B65H 75/22 242/607.1 |
| 4,221,347 | A | * | 9/1980 | Hill | B65H 75/22 242/573.6 |
| 5,025,999 | A | * | 6/1991 | Littrell | B65H 54/58 242/577 |
| 5,409,179 | A | | 4/1995 | Leclerc et al. | |
| 6,450,438 | B1 | | 9/2002 | McAllister et al. | |
| 2001/0035473 | A1 | * | 11/2001 | Patton | B65H 49/30 242/397.2 |

* cited by examiner

DEVICE FOR ADJUSTING THE INTER-FLANGE SPACE OF A BOBBIN

TECHNICAL FIELD

The present invention relates to the technical field of devices allowing winding and unwinding a link such as a cable, an optical fiber or the like.

PRIOR ART

Devices are known for winding and unwinding an energy transport link such as an optical fiber. Such a device conventionally includes:

- a mandrel including a cylindrical bearing surface upon which are arranged the inner turns of the link,
- sets of similar side arms designed to defined the volume of the link winding and to contain it laterally, playing together the role of flanges.

The arms of each set extend radially from the mandrel. The diameter of such a bobbin can be on the order of two meters.

To allow correct winding of the link on such a bobbin, it is necessary to control the position of the arms of the sets. Particularly in the case of a single-turn winding of the link on the bobbin, it is necessary that:

- each set of arms has a rotational symmetry about an axis of rotation of the mandrel,
- the distance between the proximal ends (i.e. next to the mandrel) of the arm sets is constant, and
- the distance between the distal ends (i.e. remote from the mandrel) of the arm sets is constant.

At present, there is no satisfactory means to correct the position of the side arms of the assembly.

One aim of the present invention is to propose a bobbin allowing the aforementioned shortcoming to be avoided.

SUMMARY OF THE INVENTION

To this end, a bobbin for winding and unwinding a link such as a cable or the like is proposed, including:

- a central mandrel comprising two opposite faces perpendicular to an axis of rotation of the bobbin, p1 two sets of arms, each mounted on a respective opposed face of the central mandrel, each arm being in contact with an intermediate support positioned between its ends,
  the bobbin including a plurality of adjustment elements each associated with a respective arm, the actuation of an adjustment element causing the application of a force to its associated arm thanks to the intermediate support, the application of the force tending to cause the tilt of said arm from the intermediate support so as to adjust the position of said arm in a plane containing the axis of rotation of the bobbin.

For each arm, the adjustment element and the intermediate support facilitate the adjustment of the position of the arm by leverage. The adjustment of the position of the arm is carried out by actuating a single adjustment element, which eases assembly of the bobbin by a user. Each adjustment element can for example be a threaded rod screwed into a complementary threaded opening in the arm with which said adjustment element is associated, or any other type of adjustment element allowing displacement of its associated arm by simple manipulation of the adjustment element.

Preferred, but not limiting aspects of the bobbin according to the invention are the following:

- each adjustment element is connected to the central mandrel, on the one hand, and to an arm on the other hand so as to hold said arm onto the mandrel;
- each adjustment element includes:
  - a body designed to cooperate with a complementary tool for displacing said adjustment element, and
  - an enclosure built into the body and designed to receive a portion of its associated arm, said enclosure being arranged so as to apply to its associated arm:
    - a force in a first direction when the adjustment element is displaced in a first direction,
    - a force in a second direction when the adjustment element is displaced in a second direction,
  - said forces extending in a direction substantially parallel to the axis of rotation of the bobbin;
- the forces applied by the enclosure make it possible to cause the displacement (in one direction or the other) of its associated arm from the intermediate support; this facilitates operations for adjusting the bobbin; particularly, the manipulation of a single adjustment element is sufficient to cause displacement of its associated arm.
- the body includes two opposite bases, the enclosure extending on one of the opposite bases of the body; this makes it possible to facilitate manufacture of the adjustment element and its use for assembling the bobbin.
- the enclosure includes at least two facing walls, said walls delimiting a volume suited for accommodating a portion of its associated arm.
- each wall can for example consist of a plurality of fingers positioned in a star shape, one finger of a first wall facing a finger of the facing wall; of course the walls can have other configurations such as annular, triangular, square, rectangular, and hexagonal configurations, etc.;
- the shape of the enclosure has a rotational symmetry; this makes it possible to have a constant contact surface between the enclosure and the arm portion, no matter what the position of the adjustment element, particularly when it is displaceable by screwing a threaded rod.
- the enclosure consists of a pin, particularly annular, including a throat designed to accommodate a portion of its associated arm; this makes it possible to increase the contact surface between the adjustment element and the arm on the one hand, and improves the distribution of the force applied by the adjustment element to the arm on the other hand.
- each adjustment element includes a threaded axial bore passing through its body and its enclosure to allow assembling it to a threaded rod or the like.
- the arm portion designed to enter the enclosure includes a notch; this makes it possible to increase the contact area between the enclosure and its associated arm.
- each arm includes a proximal end and a distal end, the arm portion designed to come into the enclosure of the adjustment element including the proximal end of the arm; this makes it possible to increase the intensity of the force applied by the enclosure into the arm during displacement of the adjustment element, so as to facilitate displacement of the arm about the support.
- the contact between the intermediate support and an arm is positioned at a distance from the adjustment element associated with the arm, which is less than half the length of said arm; this makes it possible to facilitate variation of the inclination of each arm about the support during application of a force thereto.

the bobbin includes a support for the coils of the link, said support extending between the two sets of arms and constituting the intermediate support of each arm.

the support is uncoupled from the mandrel and surrounds it.

the support includes a plurality of ferrules, each including a face shaped like a portion of a cylinder, said ferrules being fixed to the sets of arms so as to form a cylindrical support; this makes it possible to limit the bulk of the bobbin when it is disassembled.

the bobbin further includes at least one hoop fixed to the distal ends of the arms of a set of arms; this makes it possible to stiffen the structure of the bobbin.

the hoop consists of at least two sectors shaped like portions of a circle; this makes it possible to reduce the bulk of the bobbin when it is disassembled.

BRIEF DESCRIPTION OF THE FIGURES

Other features, aims and advantages of the present invention will still be revealed by the description that follows, which is purely illustrative and not limiting and must be read with reference to the appended drawings wherein.

DETAILED DESCRIPTION

Figure 1:
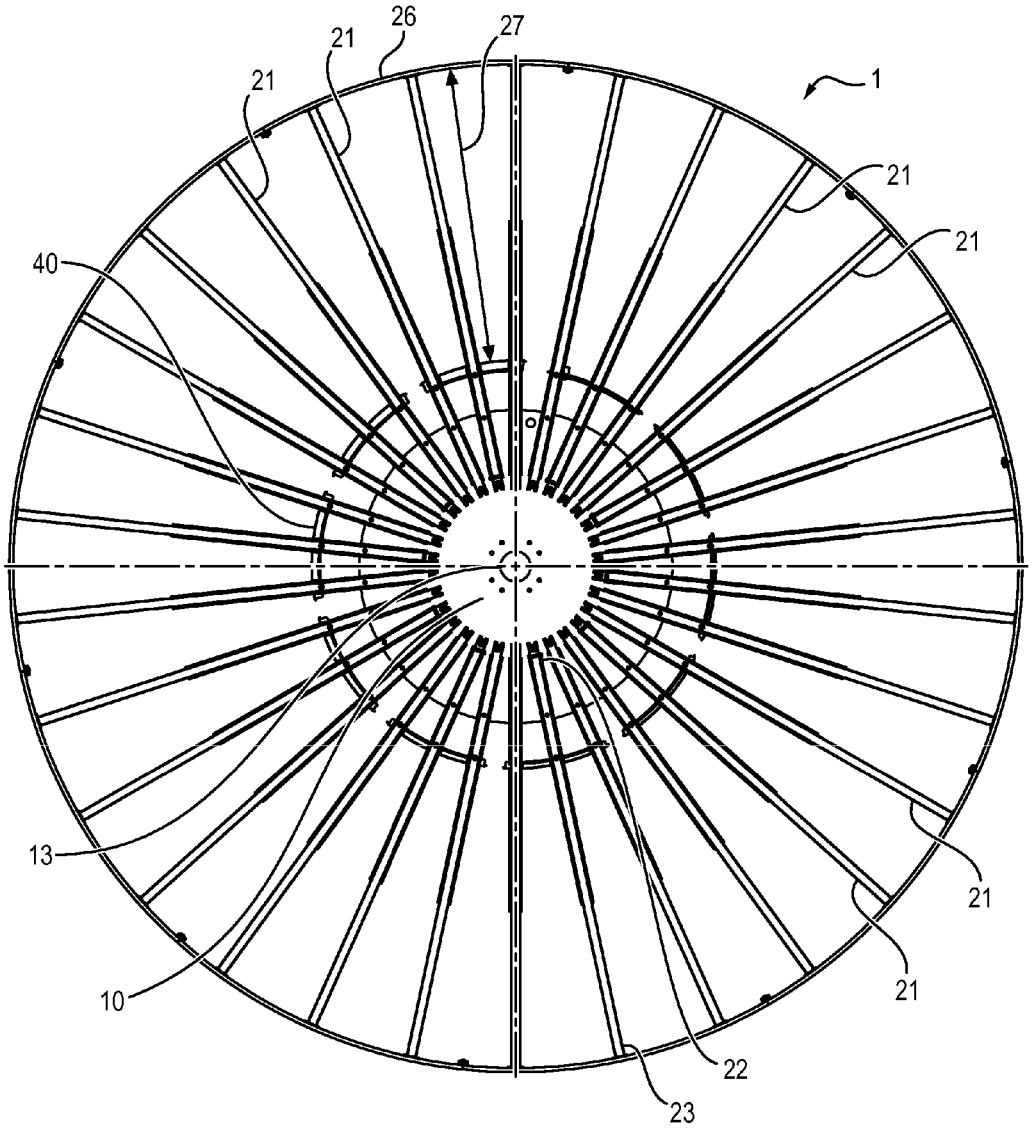
FIGS. 1 and 2 are front and profile schematic representations of a bobbin.
Figure 2:
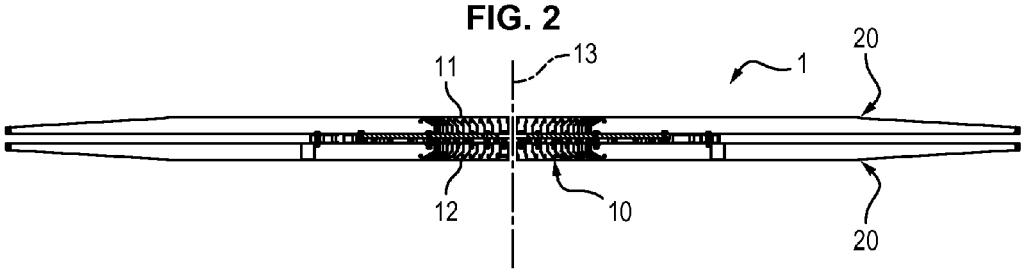

With reference to FIGS. 1 to 7, bobbin 1 as shown comprises:

a central mandrel 10, and two sets of side arms 20 similar to one another, connected to the mandrel 10 through adjustment elements 30, and each designed to play the role of a flange guiding the link in winding/unwinding.

The bobbin also includes a support 40 extending between the sets of side arms 20 to form a surface bearing the link.

Mandrel

The mandrel 10 includes two opposite circular faces 11, 12 and a side face. In the embodiment illustrated in FIGS. 1 to 7, the mandrel 10 has a cylindrical support surface. More precisely, the mandrel 10 is a disc with a thickness suited to the link to be wound/unwound.

The mandrel 10 can comprise a tube extending along its axis of revolution and forming the axis of rotation 13 of the bobbin 1.

Figure 6:
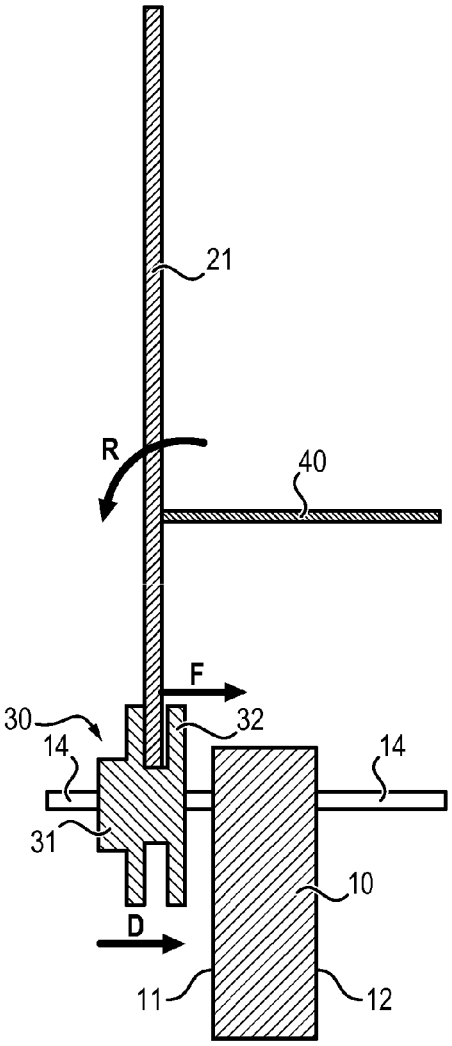
FIGS. 6 and 7 are schematic representations of an arm connected to a mandrel.
Figure 7:
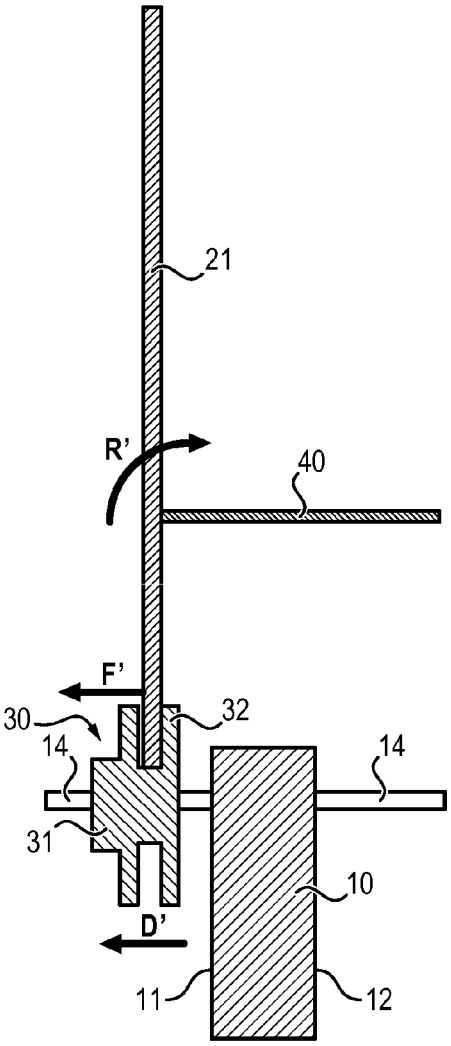

As illustrated in FIGS. 6 and 7, the mandrel 10 can comprise threaded rods 14 mounted on the periphery of each circular face 11, 12 to allow fixing of the side arms 20 using the adjustment elements 30. These threaded rods 14 can be integral with the mandrel 10 or be fixed on the mandrel 10, for example by screwing into the threaded transverse openings provided in the mandrel 10.

Set of Arms

Each set of arms 20 comprises a plurality of arms 21 extending radially from the mandrel 10. These arms 21 are of metal for example. In the embodiment illustrated in FIGS. 1 to 7, the bobbin 1 includes thirty arms 21.

Each arm 21 includes a proximal end 22 near the mandrel 10 and a distal end 23 remote from the mandrel 10.

The arms 21 are coupled to the mandrel 10 by their proximal ends 22 using a respective adjustment element 30 which will be described in more detail hereafter.

Each arm is also in contact with an intermediate support. The distance between this intermediate support and the adjustment element associated with an arm is preferably less than half the length of said arm. This intermediate support can consist of a single support part in contact with all the arms of a set of arms. As a variant, this intermediate support can consist of a plurality of members, each member being in contact with one or more arms of a set of arms. The intermediate support can be integrated into the mandrel or be remote therefrom.

Figure 3:
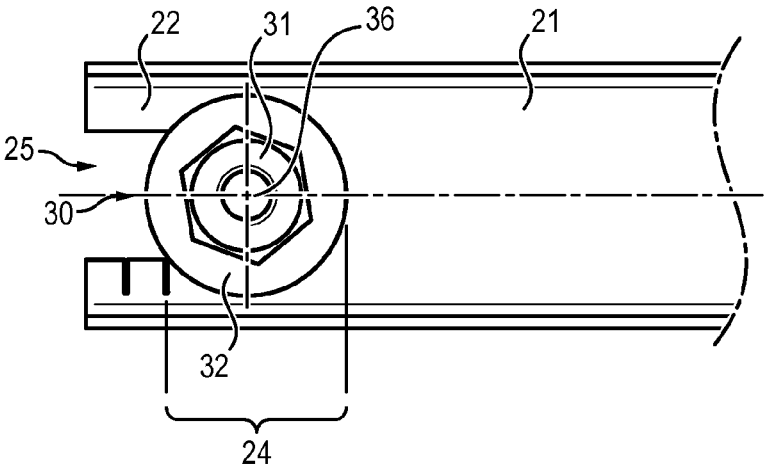
FIGS. 3 to 5 are enlarged schematic representations of a portion of an arm.
Figure 4:
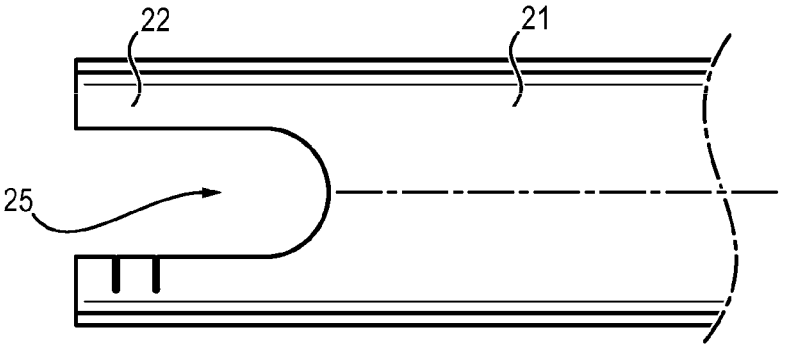
Figure 5:
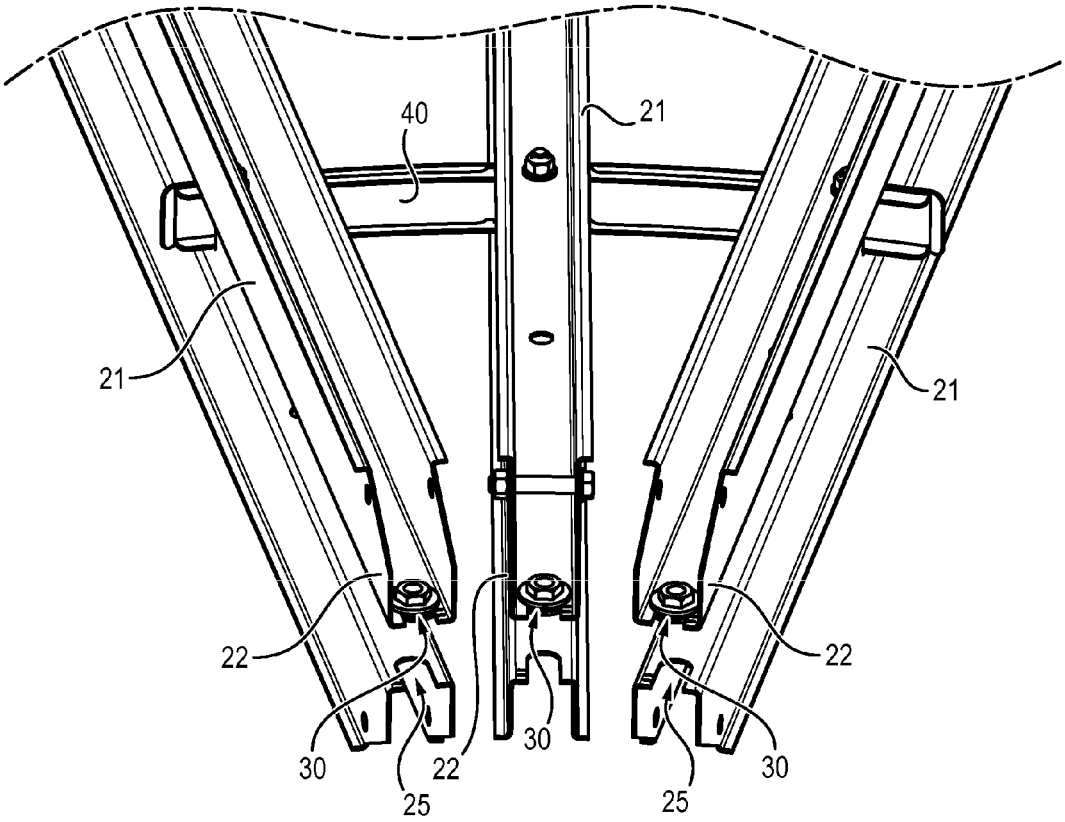

As shown in FIGS. 3 to 5, the proximal end 22 of each arm 21 can include a notch 25 designed to be inserted into an enclosure 32 of the adjustment element 30. This makes it possible to increase the contact surface between the arm 21 and the enclosure 32 of the adjustment element 30.

The distal ends 23 of the arms 21 of each set of arms 20 are fixed to a respective hoop 26 illustrated in FIG. 1. This hoop can be made of metal. The hoop 26 makes it possible to reinforce the structure of the bobbin.

Each hoop 26 can consist of two semicircular sectors or of more than two sectors shaped as portions of a circle and the juxtaposing whereof makes it possible to obtain the hoop 26. The fact that the hoop 26 consists of several juxtaposable sectors makes it possible to reduce the bulk of the bobbin once it is disassembled.

With reference to FIG. 1, the bobbin can for example include ten sectors shaped as portions of a circle. Each sector makes it possible to connect the distal ends 23 of three successive arms 21, the different sectors being juxtaposed and fixed together to form the circle 26.

Support

The bobbin 1 also includes a support 40 forming a surface bearing the link, and more precisely:

the inner turn of the link in the case of a single-turn bobbin, or the inner turns of the link in the case of a multi-turn bobbin.

This support 40 can be:

integrated with the mandrel (in this case it corresponds to the side face of the mandrel), or separated from the mandrel, as illustrated in FIGS. 1, 5, 6 and 7.

This support can constitute the intermediate support described above, or not.

The support 40 can include a smooth cylindrical sheet metal part for accommodating the turns of the link. As a variant, the support 40 can consist of a plurality of smooth segments shaped like portions of a cylinder and the juxtaposing whereof allows the formation of a cylinder.

Referring to FIG. 1, the support 40 can for example consist of ferrules extending between the sets of side arms 20. These ferrules are fixed—by screwing for example—to the arms 21, and extend a given distance 27 from the distal ends 23 of said arms 21.

When the support constitutes the intermediate support, this distance 27 is preferably greater than half the total length of an arm 21. In the example illustrated in FIG. 1, the distance 27 between the distal end 23 of an arm 21 and the ferrule fixing area on the arm 21 is equal to ⅔ the total length of the arm 21.

Each ferrule consists of a sheet-metal part in the shape of a portion of a cylinder. juxtaposing the ferrules makes is possible to form a cylinder defining a smooth bearing surface on which will be positioned the inner turns of the link intended to be wound on the bobbin 1.

Adjustment Elements

Figure 8:
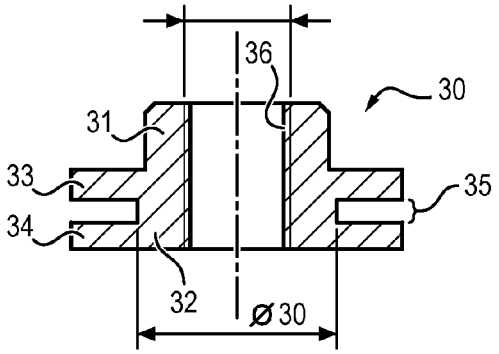
FIGS. 8 to 10 are schematic representations of an adjustment element in section, from the front and in perspective.
Figure 9:
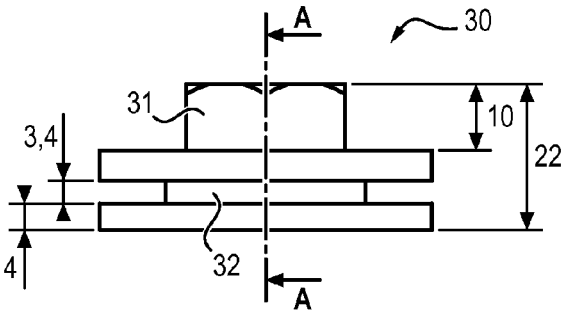
Figure 10:
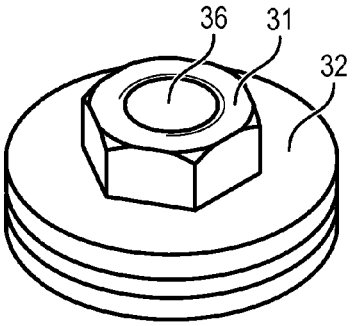

With reference to FIGS. 8 to 10, an example of an adjustment element 30 used for coupling an arm 21 to the mandrel 10 and adjusting the position of said arm has been illustrated.

Each adjustment element 30 includes a body 31, a peripheral circumferential enclosure 32 and a threaded bore 36 passing axially through the body 31.

The body 31 is designed to cooperate with a complementary tool to induce the movement of the adjustment element. The body 31 includes two opposite bases and a peripheral face the shape whereof is complementary to that of a tightening tool of the adjustment element 30. The peripheral face is hexagonal, for example.

The enclosure 32 is designed to receive a portion 24 of a respective arm 21 (see FIG. 5). The enclosure 32 includes at least two walls 33, 34 delimiting a volume 35 suited for accommodating an end portion 24 of a respective arm 21. This enclosure 32 consists for example of an annular pin extending over one of the bases of the body 31 and including a groove on its side face. This groove is designed to accommodate a portion 24 of an arm 21. The use of such an adjustment element makes it possible to reduce the bulk of the bobbin. More precisely, the use of such an adjustment element including a pin including a slot makes possible the manufacture of a bobbin with a small thickness, the part of the adjustment element situated between the arm and the mandrel having little thickness.

As described in more detail hereafter with reference to FIGS. 6 and 7, the adjustment element 30 is arranged so as to apply a force F or F' to its associated arm 21, by means of the enclosure 32, when the adjustment element 30 is displaced. This force F or F' exerted by the enclosure 32 extends in a plane containing the axis of rotation 13 of the bobbin 1. The direction of the force depends on the displacement direction of the adjustment element 30.

The application of this force F, F' to the arm 21 brings about a displacement R or R' of the arm 21 about its connection with the support 40. Thus it is possible to adjust the positions of the arms 21 of the sets of side arms 20 so that:

- each set of arms has a rotational symmetry about the axis of rotation 13 of the bobbin,
- the distance between the proximal ends (i.e. near the mandrel) of the sets of arms is constant, and
- the distance between the distal ends (i.e. remote from the mandrel) of the sets of arms is constant.

For example, it is possible to make the arms 21 of the sets of side arms 20 coplanar in their region located radially outside the mandrel.

As a variant, it is possible to adjust the positions of the arms so that:

- the arms of each set of arms are contained in a cone with an axis of symmetry combined with the axis of rotation of the bobbin,
- the distance between the proximal ends (i.e. near the mandrel) of the sets of arms is constant, for example equal to 54 millimeters, and
- the distance between the distal ends (i.e. far from the mandrel) of the sets of arms is constant, for example equal to 51 millimeters.

To this end, the adjustment element 30 includes the threaded bore 36 through which it is mounted, by screwing:

- on a screw (not shown) passing through an opening provided in the mandrel, or
- on a threaded rod, integral or not with the mandrel.

Principle of Operation

Thanks to the use of an adjustment element such as that illustrated in FIGS. 8 to 10, the assembly and more particularly the adjustment of the bobbin 1 is facilitated.

Indeed, during assembly of the bobbin 1, one of the operations that are difficult to implement relates to the adjustment of the position of the arms, for example the coplanar positioning of the sets of side arms 20. More precisely, it is necessary to put each arm 21 of a set of arms 20 into a plane parallel to the plane containing the arms 21 of the other set of arms 20 facing it.

The fact that the distances between the sets of side arms 20 are constant at their proximal and distal ends is very important for allowing correct winding/unwinding of the link, particularly in the case of a single-turn bobbin.

The principle of adjustment of a bobbin 1 by actuating the adjustment elements 30 is the following.

Once the arms 21 are fixed to the mandrel 10 and the support 40, the user adjusts the distance between each arm 21 of a set of arms 20 and the arm 21 of the other set of arms 20 facing it so as for example to make the set of arms coplanar in mutually parallel planes.

To do this, the user displaces by screwing the adjustment element 30 of the arm 21 to be adjusted depending on the distance between the facing arms 21.

More precisely:

a. If the distance between the distal ends 23 of the facing arms 21 is less than the distance between the proximal ends 22 of the facing arms 21, then the user screws the adjustment element 30 onto the threaded rod 14 mounted on the mandrel 10.

This induces a displacement D of the adjustment element 30 toward the mandrel 10. As it is displaced, the enclosure 32 of the adjustment element 30 applies a force F on the proximal end 22 of the arm 21, the direction of this force F being parallel to the axis of rotation of the bobbin 1 and the direction of this force F being the same as the direction of displacement D of the adjustment element 30 (to wit, toward the mandrel).

The application of this force F has the effect of "pushing" the proximal end 22 of the arm 21 toward the mandrel 10, which induces the displacement R of the arm 21 about its contact area with the intermediate support (the support 40 in the example).

During the gradual displacement D of the adjustment element 30 toward the mandrel 10, the distal end 23 of the arm 21 separates from the distal end 23 of the facing arm 21.

When the distance between the distal ends 23 of the facing arms 21 is equal to the distance between the proximal ends 22 of the facing arms 21, the user stops his action on the adjustment element 30 so as to interrupt its displacement D. The facing arms 21 are then coplanar.

b. If, on the other hand, the distance between the distal ends 23 of the facing arms 21 is greater than the distance between the proximal ends 22 of the facing arms 21, then the user unscrews the adjustment element 30.

This induces a displacement D' of the adjustment element 30, which separates from the mandrel 10. As it is displacing, the enclosure 32 of the adjustment element 30 applies a force F' to the proximal end 22 of the arm 21, the direction of this force F' being parallel to the axis of rotation of the bobbin 1 and the direction of this force F' being the same as the direction of displacement D' of the adjustment element 30.

The application of this force has the effect of "pulling" the proximal end 22 of the arm 21, which induces the variation of inclination R' of the arm 21 about its contact area with the intermediate support (here, the support 40). During the gradual displacement D' of the adjustment element 30 toward the mandrel 10, the distal end 23 of the arm 21 approaches the distal end 23 of the facing arm 21. When the distance between the distal ends 23 of the facing arms 21 is equal to the distance between the proximal ends 22 of the facing arms 21, the user stops his action on the adjustment element so as to interrupt its displacement. The facing arms are then parallel.

Thus the adjustment of the bobbin 1 is facilitated for the user, who does not need to manipulate several parts with difficult access to make the sets of arms 21 coplanar, in parallel planes.

The invention claimed is:

1. A bobbin for winding and unwinding a link such as a cable or the like onto the bobbin, including:

a central mandrel including two opposite faces perpendicular to an axis of rotation of the bobbin, two sets of arms, each of the two sets of arms being mounted on a respective opposite face of the central mandrel, each arm being provided with a proximal end near the central mandrel, and a distal end opposite the proximal end, each arm being in contact with an intermediate support positioned between the proximal end and the distal end of the arm, wherein the bobbin includes a plurality of adjustment elements, each adjustment element being connected to a respective arm, an actuation of the adjustment element inducing the application of a force to the respective arm by leverage about the intermediate support, the application of the force tending to cause variation of the inclination of the respective arm in a plane essentially parallel to the axis of rotation of the bobbin so as to adjust the position of the arm in the plane.

2. The bobbin of claim 1, wherein each of the adjustment elements is connected to both the central mandrel and a respective arm, so as to maintain the arm on the mandrel.

3. The bobbin of claim 1, wherein each adjustment element includes:

a movable body, and an enclosure integral with the body and designed to accommodate a portion of the respective arm, the enclosure being arranged so as to apply on the respective arm:

a force in a first direction when the adjustment element is displaced in the first direction, a force in a second direction when the adjustment element is displaced in the second direction, wherein the first and second directions are substantially parallel to the axis of rotation of the bobbin.

4. The bobbin of claim 3, wherein the body includes two opposite bases, the enclosure extending over one of the opposite bases of the body.

5. The bobbin of claim 4, wherein the portion of the respective arm designed to enter the enclosure includes a notch.

6. The bobbin of claim 4, wherein the portion of the respective arm designed to enter the enclosure of the adjustment element includes the proximal end of the respective arm.

7. The bobbin of claim 6, wherein the contact between the intermediate support and a respective arm is positioned at a distance from the adjustment element associated with the arm that is less than half of the length of the arm.

8. The bobbin of claim 3, wherein the enclosure includes at least two facing walls, the walls delimiting a volume designed to accommodate a portion of the respective arm.

9. The bobbin of claim 3, wherein the shape of the enclosure is axially symmetric.

10. The bobbin of claim 3, wherein the enclosure includes a pin including a groove designed to accommodate a portion of the respective arm.

11. The bobbin of claim 3, wherein each adjustment element includes a threaded axial bore passing through the body and the enclosure to allow mounting the adjustment element to a threaded rod or the like.

12. The bobbin of claim 1, further including a support for the turns of the link, the support extending between the two sets of arms and constituting the intermediate support of each respective arm.

13. The bobbin of claim 12, wherein the support is dissociated from the mandrel and surrounds it.

14. The bobbin of claim 1, wherein the support includes a plurality of ferrules each including a face shaped as a portion of a cylinder, the ferrules being fixed to the sets of arms so as to form a cylindrical support.

15. The bobbin of claim 1, further including a hoop fixed to the distal ends of the arms of a set of arms.

16. The bobbin of claim 15, wherein each hoop consists of at least two sectors shaped as a portion of a circle.

* * * * *